US005749456A

United States Patent [19]

Logie

[11] Patent Number: 5,749,456

[45] Date of Patent: May 12, 1998

[54] STACK TRANSPORT DEVICE

[75] Inventor: Alexander W. Logie, West Lothian, Scotland

[73] Assignee: NCR Corporation, Dayton, Ohio

[21] Appl. No.: 599,219

[22] Filed: Feb. 9, 1996

[30] Foreign Application Priority Data

Oct. 21, 1995 [GB] United Kingdom ..... 9521615

[51] Int. Cl.[6] ..... B65G 37/00

[52] U.S. Cl. ..... 198/626.5

[58] Field of Search ..... 198/626.1, 626.2–626.6

[56] References Cited

U.S. PATENT DOCUMENTS

| | | | |
|---|---|---|---|
| 555,481 | 2/1896 | Grimmett | 198/626.4 |
| 4,457,422 | 7/1984 | Hurd | 198/626.6 |
| 4,697,944 | 10/1987 | Peebles et al. | 198/626.6 |
| 5,267,826 | 12/1993 | Peters | 198/626.5 |

FOREIGN PATENT DOCUMENTS

| | | | |
|---|---|---|---|
| 37879 | 10/1981 | European Pat. Off. | 198/626.1 |
| 583761 | 1/1925 | France | 198/626.1 |
| 2621305 | 4/1989 | France . | |
| 477367 | 6/1929 | Germany | 198/626.1 |
| 3424389 | 3/1985 | Germany . | |
| 404055206 | 2/1992 | Japan | 198/626.1 |
| 554186 | 8/1974 | U.S.S.R. | 198/626 |
| 2126998 | 4/1984 | United Kingdom . | |

*Primary Examiner*—Joseph E. Valenza
*Assistant Examiner*—Khoi H. Tran
*Attorney, Agent, or Firm*—Michael Chan

[57] ABSTRACT

The invention relates to a stack transport device for transporting a stack of bank notes (14) through a large angle, such as 90 degrees, without shearing. The device comprises belts (10, 10',12 and 12') driven at identical speeds; a pivoted support (26) over which the belts (10,10',12 and 12') pass; and a drive (38) to pivot the support (26) through the angle, when the stack (14) is supported by a portion of the belt means (10, 12) which is in turn supported by the support (26).

8 Claims, 4 Drawing Sheets

STACK TRANSPORT DEVICE

BACKGROUND OF THE INVENTION

This invention relates to a device for transporting a stack of media, such as bank notes or other paper sheets, through a substantial angles such as 90 degrees.

If a stack of bank notes is to be transported from one location to another, it is highly preferable that the stack retain its integrity. Such transport conveniently takes place using two pairs of co-operating drive belts, the two pairs of drive belts being located close to opposing edges of the notes forming the stack, with the stack being held between them. If the stack is to be moved through a substantial angle, there is a risk that the stack will suffer shear separation with one or more notes being displaced with respect to adjacent notes, unless the angular movement is achieved through a series of small steps, i.e. the angle of the pairs of belts is changed around a large radius of curvature.

One device requiring transport of a stack of bank notes is a teller assist device for use, say in a bank, to supply stacks of notes to a teller, under secure conditions. Such devices are commonly arranged under the desks or counters at which tellers are seated. Consequently, space is limited and notes, once picked from the currency storage cassettes in which they are stored, should ideally be transported vertically prior to being moved through an angle of approximately 90°, to be presented to the teller, through a slot in the front face of the teller assist device. It has been found that if drive belts are used to give a sharp 90 degree rotation, say by passage over a roller, the integrity of the stack of notes can be lost, either by severe displacement of the notes relative to each other, or by displacement of a number of notes in the centre of the stack.

SUMMARY OF THE INVENTION

It is an object of the present invention to provide a device for transporting a stack of bank notes, or other sheets, through a substantial angle while retaining the integrity of the stack.

According to the present invention there is provided a stack transport device including belt means for holding and feeding a stack of sheets along a feed path from an entry point to an exit point, the exit direction of feed of said stack approaching said exit point being at an angle to the entry direction of feed leaving said entry point, characterized by pivotably mounted support means for supporting a portion of said belt means intermediate said entry and exit points, and control means arranged to cause said support means to pivot between a first position and a second position while said stack is held by said portion of said belt means, said portion of said belt means being substantially aligned with said entry direction of feed when said support means is in said first position and being substantially aligned with said exit direction of feed when said support means is in said second position.

BRIEF DESCRIPTION OF THE DRAWINGS

An embodiment of the invention will now be described, by way of example only, with reference to the accompanying drawings in which.

DETAILED DESCRIPTION

Figure 2:
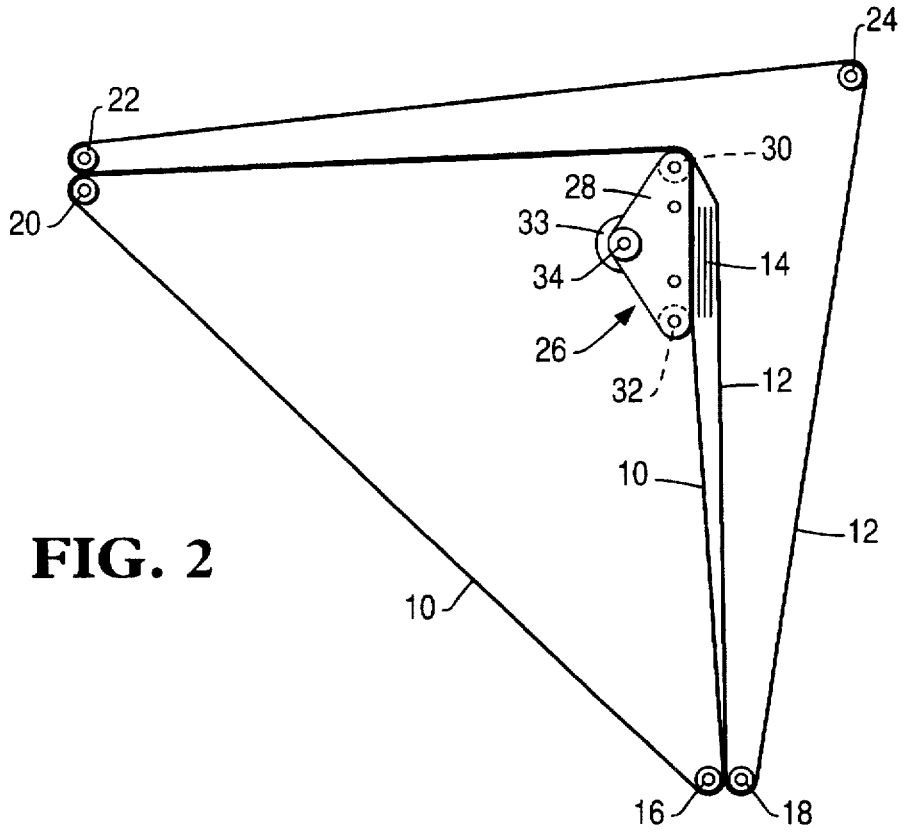
FIG. 2 is a schematic side view of the device of FIG. 1A, in which said support means has received said portion of said drive belt means supporting the stack.
Figure 3:
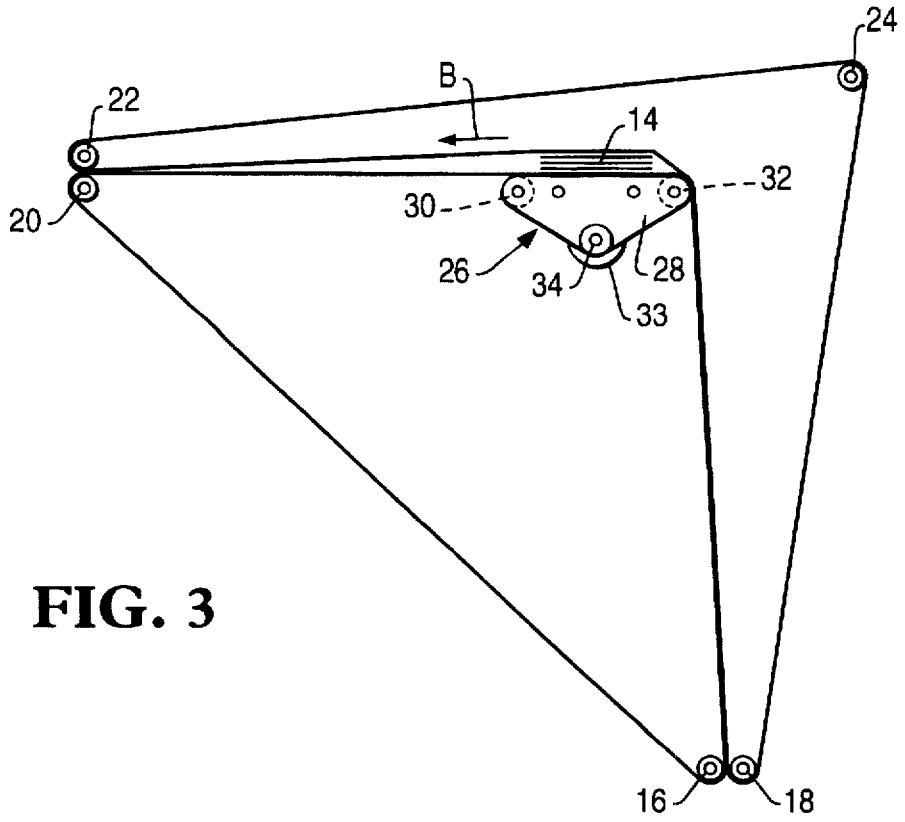
FIG. 3 is a schematic side view of the device of FIG. 1A, in which the support means has moved to a second position, with the stack still held by said portion of said drive belt means.
Figure 4:
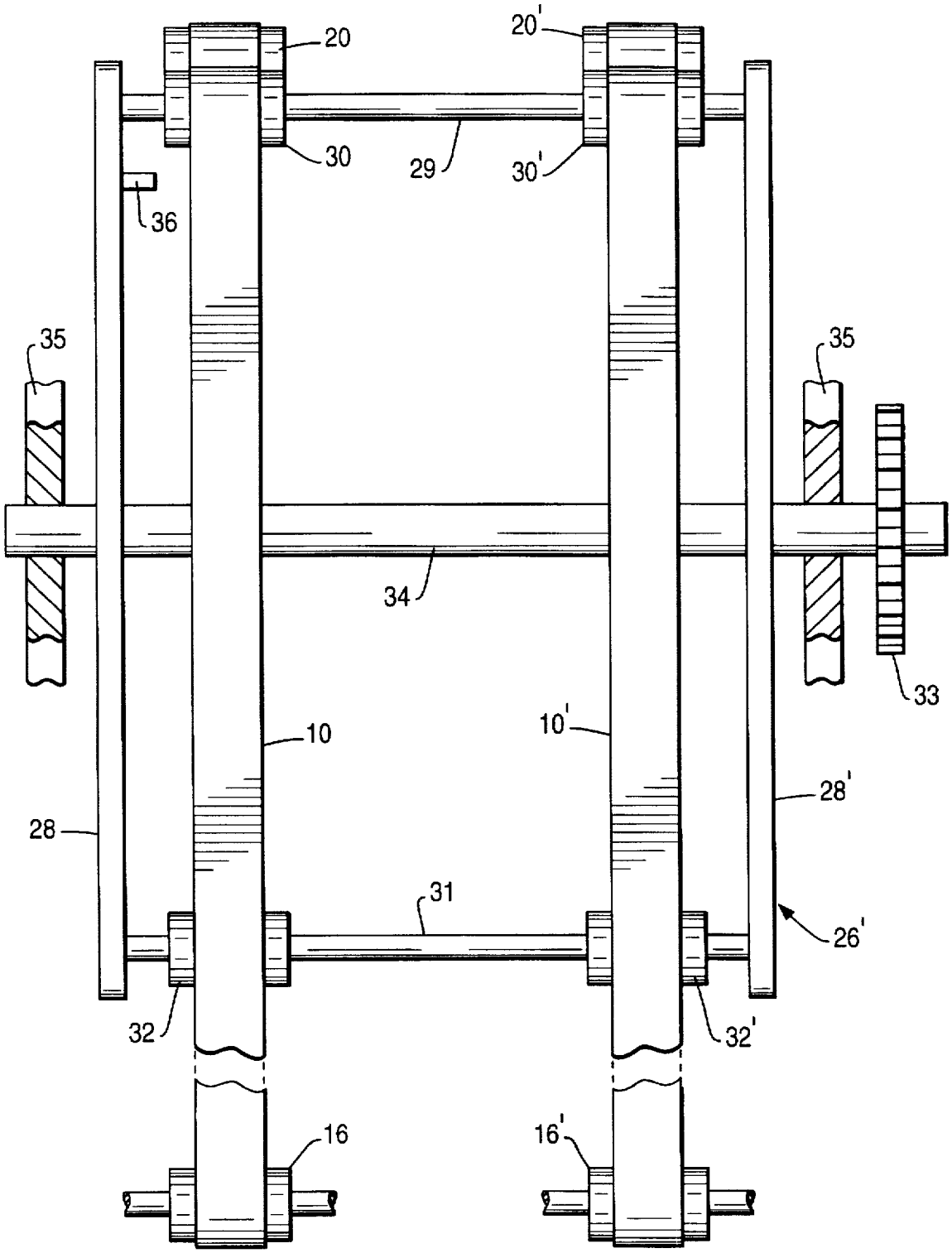
FIG. 4 is an enlarged view of the support means, together with associated parts of the drive belt means, the view being taken from right to left with reference to FIG. 1A.

FIGS. 1 to 4 illustrate a stack transport device in accordance with the present invention. The device incorporates a support means 26 including two parallel side plates 28 and 28' which are connected by two support rods 29 and 31 and by a pivot rod 34, as illustrated in FIG. 4. The first support rod 29 has mounted thereon two idler rollers 30 and 30', separated by a distance slightly less than the approximate width of the bank notes to be transported by the device. This distance can be adjusted for different currencies or for different types of sheets by moving the rollers 30 and 30' along the support rod 29. The second support rod 31 has a further two similarly positioned idler rollers 32 and 32' mounted thereon.

Figure 5:
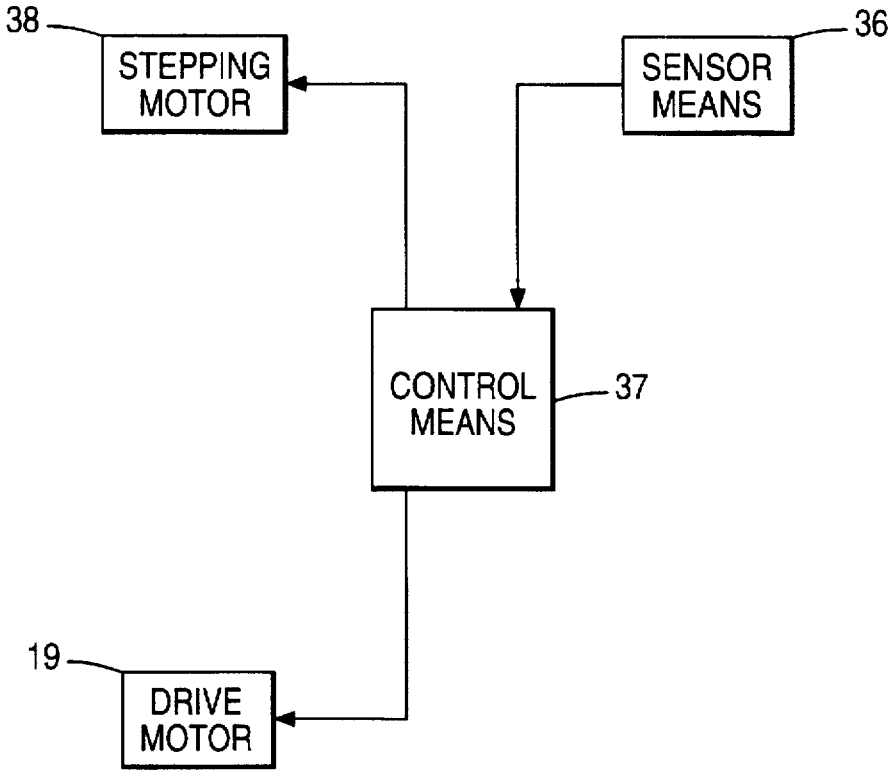
FIG. 5 is a block diagram of parts of the device of FIG. 1A.

The pivot rod 34 is pivotably mounted with respect to a framework 35 of the device and is connected to a gear mechanism 33, which is in turn connected to a stepping motor 38 (FIG. 5) which rotates the support means 26 when in use, as will be discussed in detail below.

Figure 1A:
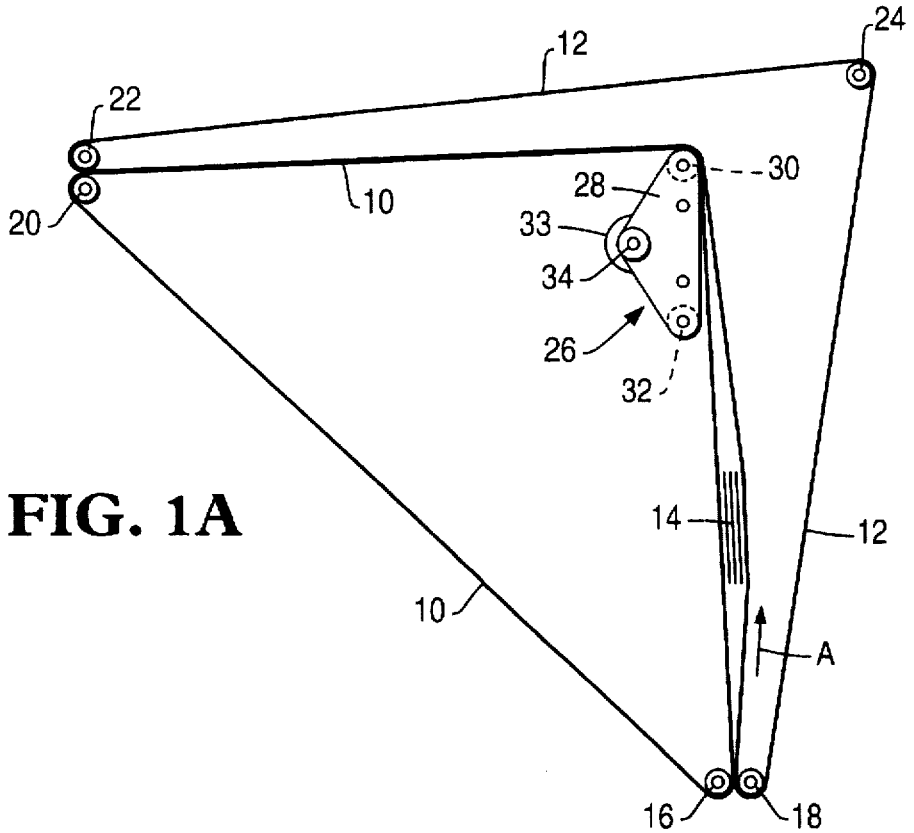
FIG. 1A is a schematic side view of a transport device in accordance with the present invention, illustrating the pivotable support means in a first position, with the support means awaiting receipt of a stack of notes supported by a portion of the belt means.
Figure 1B:
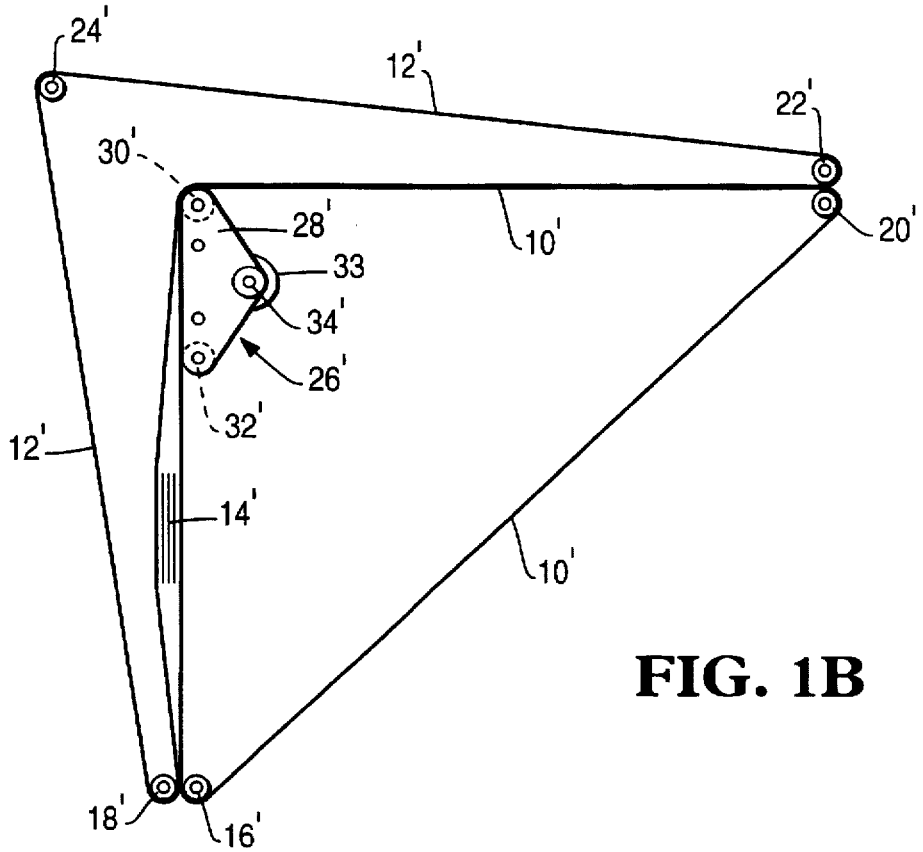
FIG. 1B is a schematic side view of the transport device of FIG. 1A, taken from the opposite side of the device.

The support means 26 is positioned substantially at the apex of a triangle the base corners of which are formed by two drive rollers 16 and 16' and two idler rollers 20 and 20' (FIGS. 1A & 1B) rotatably mounted with respect to the framework 35. A first endless drive belt 10 is passed over the aforementioned rollers 16 and 20 and the first two idler rollers 30 and 32 on the support means 26, as illustrated in FIG. 1A. A second endless drive belt 10' is also passed over the second set of corresponding rollers 16', 20', 30' and 32', as illustrated in FIG. 1B. A third endless drive belt 12 is passed over a further drive roller 18 and idler roller 22 and a second idler roller 24 located remote from the support means 26, (FIGS. 1A, 2 and 3). Again, a further drive belt 12' is passed over the corresponding rollers 18', 22' and 24' (FIG. 1B). Thus the drive belts 10, 12 and 10', 12' are located adjacent each other so as to be urged towards and support a stack 14 of notes located between the belts. Consequently, the drive belts form a feed path along which a stack 14 of notes can be transported by controlled movement of the drive belts 10, 10',12 and 12'. It will be appreciated that the idler rollers 30, 30' and 32, 32' included in the support means 26 support a portion of the co-operating belts 10, 10' and 12, 12' intermediate the entry point (location of rollers 16, 18') and exit point (location of rollers 20, 22 and 20', 22') of the stack transport device.

The support means 26 is associated with a sensor 36 arranged to detect the presence of a stack 14 of notes; the sensor 36 is connected to a control means 37, in the form of a processor, which is in turn connected to the stepping motor 38 which moves the support means 26 on the pivot 34.

The belts 10, 12 and 10', 12' travel in the direction shown by the arrow A (FIG. 1A), under the influence of a drive motor 19 (FIG. 5) which drives the drive rollers 16, 16', 18 and 18', at identical speeds, through a gear mechanism (not shown). The drive motor 19 is also controlled by the control means 37.

After the stack 14 of notes has entered the transport device, the belts 10, 12 and 10', 12' hold the stack 14 of notes between them and feed the stack 14 towards the support 26, the portion of the co-operating belts 10, 10' and 12, 12' supported by the idler rollers 30, 30' and 32, 32' of the support means 26 being substantially aligned with the initial direction of feed of the stack 14 in the transport device (indicated in FIG. 1A by arrow A). As the leading edge of the stack 14 passes the sensor 36, its presence is detected, and the sensor 36 sends a signal to the control means 37 which operates the stepping motor 38 to rotate the support means 26 through 90 degrees about the pivot 34 to the position shown in FIG. 3.

The delay between the signal produced by the sensor 36 being received by the control means 37 and the control means 37 instructing the drive means 38 to pivot the support means from the first to the second position, is determined by the control software in the control means 37 and can be altered as required. When the support means 26 commences its pivoted movement from its first position shown in FIG. 2, the stack 14 is held by the aforementioned portion of the co-operating belts 10, 10' and 12, 12' with the stack 14 being centrally positioned between the rollers 30, 30' and 32, 32'. During this pivotal movement the belts 10, 10' and 12, 12' continue to be driven at the same speed. The speed of rotation of the support means 26 is such that when the support means 26 reaches its second position shown in FIG. 3 the stack 14 is still centrally positioned with respect to the rollers 30, 30' and 32, 32'. After the support means 26 reaches its second position, the belts 10, 10' and 12, 12' feed the stack 14 towards the exit point of the transport device, the aforementioned portion of the belts 10, 10' and 12, 12' being substantially aligned at this time with the exit direction of feed of the stack 14 (indicated by the arrow B in FIG. 3).

It will be clear from FIGS. 2 and 3 that as the support means 26 pivots, no shearing forces are applied by the drive belts 10, 10'; 12 and 12' to the stack 14. The stack 14 therefore retains its integrity. The intact stack 14 can then be passed between the idler rollers 20, 22 and 20', 22'. It should be understood that each pair of rollers; 16, 18; 16', 18'; 20, 22; and 20', 22' are spring mounted to permit the stack 14 to pass between them as it enters and leaves the transport device, while urging the belts into contact with the stack 14 of notes, when in use.

On leaving the support means 26 the stack 14 is transported by additional belt means (not shown) to a delivery position where it can be collected by a bank teller. On delivery, the stack is easy to handle manually, and appears neat, which gives the teller more confidence that the stack contains the correct number of notes.

Comparison of FIGS. 2 and 3 will also show that the spacing between the pivot 34 and the idler roller 24 is constant, but the distances between the idler roller 24 and the idler rollers 30, 32 respectively on the pivoted support means 26 change as the support means 26 pivots. Preferably the belts 10, 10', 12 and 12' are made of an elastic material such as rubber to accommodate any slight length changes during pivoting of the support means 26. The device can also incorporate a known belt tensioning device to keep the belts tensioned during the pivoting motion.

The stepper motor 38 is arranged to rotate the support 26 on the pivot 36 back through 90 degrees to the position shown in FIG. 1A after the stack 14 of notes is transported away from the support means 26, by additional drive belts (not shown).

The transport device according to the invention is sufficiently compact to be provided in a confined space, e.g. under a Bank counter or teller's desk, and to transport bank notes through 90 degrees within this space. The device may also be provided as a module which can be incorporated into other media transportation mechanism, such as that used in automated teller machines (ATMs).

While the invention has been described with reference to the transport of a stack of bank notes through 90 degrees, it may be used to transport stacks of notes through other large angles, and to transport stacks of sheets other than bank notes. Also an additional pair of belts may be positioned centrally in the device between the existing pairs of belts 10,12 and 10', 12' to provide additional support to the stack 14 during transportation.

What is claimed is:

1. A stack transport device for transporting a stack of sheets along a feed path defined between an entry point to the feed path and an exit point from the feed path, the stack transport device comprising:

first and second belt arrangements defining the feed path and cooperating with each other to hold and feed a stack of sheets along the feed path from the entry point to the exit point;

a support member for supporting the first and second belt arrangements such that the entry direction of feed leaving the entry point along the feed path is at an angle relative to the exit direction of feed of a stack of sheets approaching the exit point along the feed path, the support member being pivotable between a first position in which a first portion of the feed path is awaiting receipt of a stack of sheets from the entry point and a second position in which a second portion of the feed path is awaiting release of a stack of sheets towards the exit point;

a pivot post for allowing the support member to pivot between the first and second positions; and a controller for (i) controlling the support member to pivot about the pivot post in a first direction from the first position to the second position when a stack of sheets is received in the first portion of the feed path from the entry point, and (ii) controlling the support member to pivot about the pivot post in a second direction which is opposite the first direction from the second position back to the first position when a stack of sheets is released from the second portion of the feed path towards the exit point.

2. A stack transport device according to claim 1, further comprising a drive motor for driving the first and second belt arrangements at identical speeds.

3. A stack transport device according to claim 1, wherein (i) the first belt arrangement includes a first pair of belts which grip a stack of sheets along one edge of the stack, and (ii) the second belt arrangement includes a second pair of belts which grip the stack along an opposite edge of the stack.

4. A stack transport device according to claim 3, wherein the belts of each pair of belts pass around respective pairs of rollers which are biased towards each other.

5. A stack transport device according to claim 1, further comprising a sensor for detecting the presence of a stack of sheets at the support member and for supplying a corresponding signal to the controller to allow the controller to control the support member to pivot about the pivot post between the first and second positions.

6. A stack transport device according to claim 5, wherein the controller controls the support member to pivot the support member about the pivot post from the second position back to the first position after the sensor detects that a stack of sheets has been transported away from the support member.

7. A stack transport device according to claim 1, wherein the support member includes a number of idler rollers adapted to support the first and second belt arrangements, each of the idler rollers being located adjacent a corner of the support member.

8. A stack transport device according to claim 1, wherein the controller controls the speed of pivotal movement of the support member about the pivot post so that a stack of sheets is in the same position relative to the support member at the beginning and at the end of pivotal movement from the first position to the second position.

* * * * *